US009470425B1

(12) United States Patent
Cink et al.

(10) Patent No.: US 9,470,425 B1
(45) Date of Patent: Oct. 18, 2016

(54) DEHUMIDIFIER

(71) Applicant: Technologies Holdings Corp., Houston, TX (US)

(72) Inventors: David M. Cink, Sun Prairie, WI (US); Vincent Yu, Madison, WI (US); Kenneth C. Gehring, Cottage Grove, WI (US); Timothy S. O'Brien, Deforest, WI (US)

(73) Assignee: Technologies Holdings Corp., Houston, TX (US)

( * ) Notice: Subject to any disclaimer, the term of this patent is extended or adjusted under 35 U.S.C. 154(b) by 42 days.

(21) Appl. No.: 14/707,589

(22) Filed: May 8, 2015

Related U.S. Application Data

(63) Continuation of application No. 13/298,163, filed on Nov. 16, 2011, now Pat. No. 9,052,132, which is a continuation-in-part of application No. 12/016,858, filed on Jan. 18, 2008, now Pat. No. 8,069,681.

(51) Int. Cl.
*F24F 3/14* (2006.01)

(52) U.S. Cl.
CPC ..... *F24F 3/1405* (2013.01); *F24F 2003/1446* (2013.01)

(58) Field of Classification Search
CPC ..... F24F 3/1405; F24F 2003/1446
See application file for complete search history.

(56) References Cited

U.S. PATENT DOCUMENTS

| | | | | |
|---|---|---|---|---|
| 2,682,758 | A | 7/1954 | Harris | |
| 4,428,207 | A | 1/1984 | Hall | |
| 4,561,492 | A | 12/1985 | Bellows | |
| 4,616,695 | A | 10/1986 | Takahashi et al. | |
| 5,309,725 | A * | 5/1994 | Cayce | F24F 3/1405 62/173 |
| 5,901,565 | A * | 5/1999 | Morton, Jr. | F25D 21/14 62/285 |
| 7,168,482 | B2 | 1/2007 | Lee et al. | |
| 7,194,870 | B1 * | 3/2007 | O'Brien | F24F 3/153 62/185 |
| 2008/0022705 | A1 * | 1/2008 | Clearman | F24F 3/1405 62/173 |

OTHER PUBLICATIONS

Ab SEgerfrojd Company, Dec. 18, 2006, Web page (www.segerfrojd.com).

* cited by examiner

*Primary Examiner* — Emmanuel Duke
(74) *Attorney, Agent, or Firm* — Andrus Intellectual Property Law, LLP

(57) ABSTRACT

A cross-flow heat exchanger, method of making a cross-flow heat exchanger, and a dehumidifier are provided. The cross-flow heat exchanger has an axial flow path extending through the heat exchanger from an inlet to an outlet and a transverse flow path oriented transversely to the axial flow path and extending through the heat exchanger from an inlet to an outlet. The transverse flow path is adjacent to and separate from the axial flow path. The surface area of the inlet of the axial flow path is less than the surface area of the outlet of the axial flow path. In a preferred embodiment, the heat exchanger has an exterior shape that is trapezoidal.

22 Claims, 18 Drawing Sheets

FIG. 7
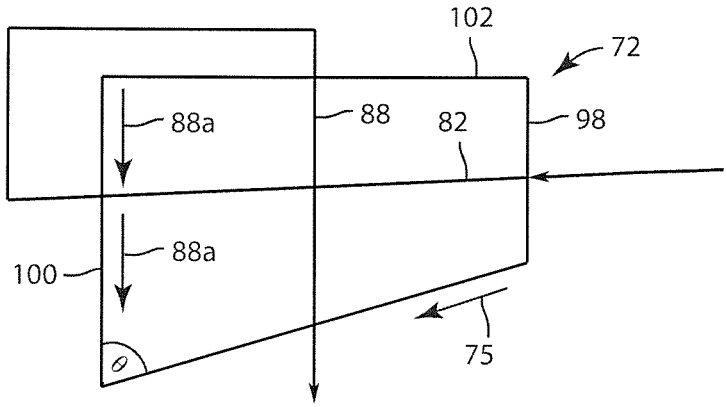
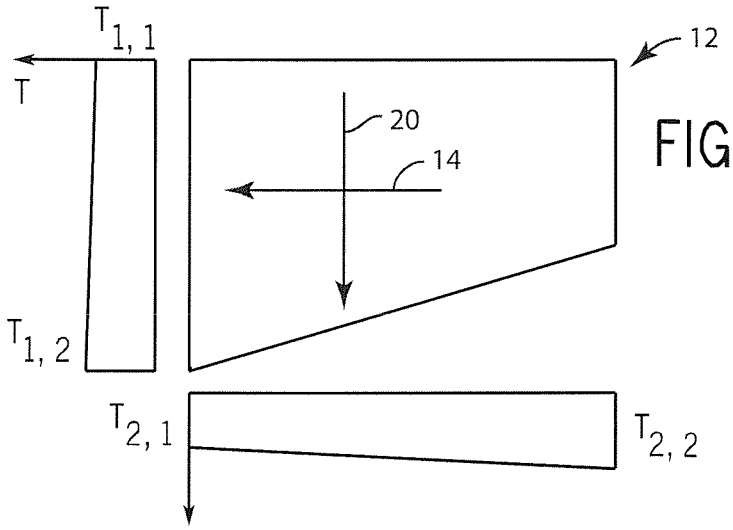
FIG. 8
FIG. 9A
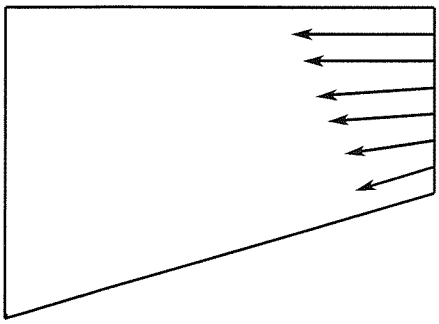
FIG. 9B
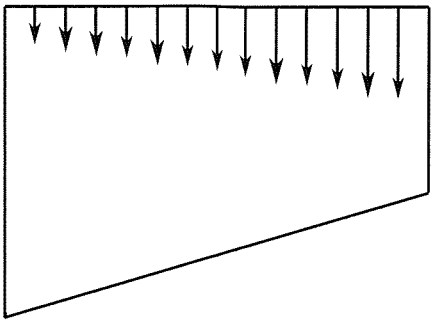

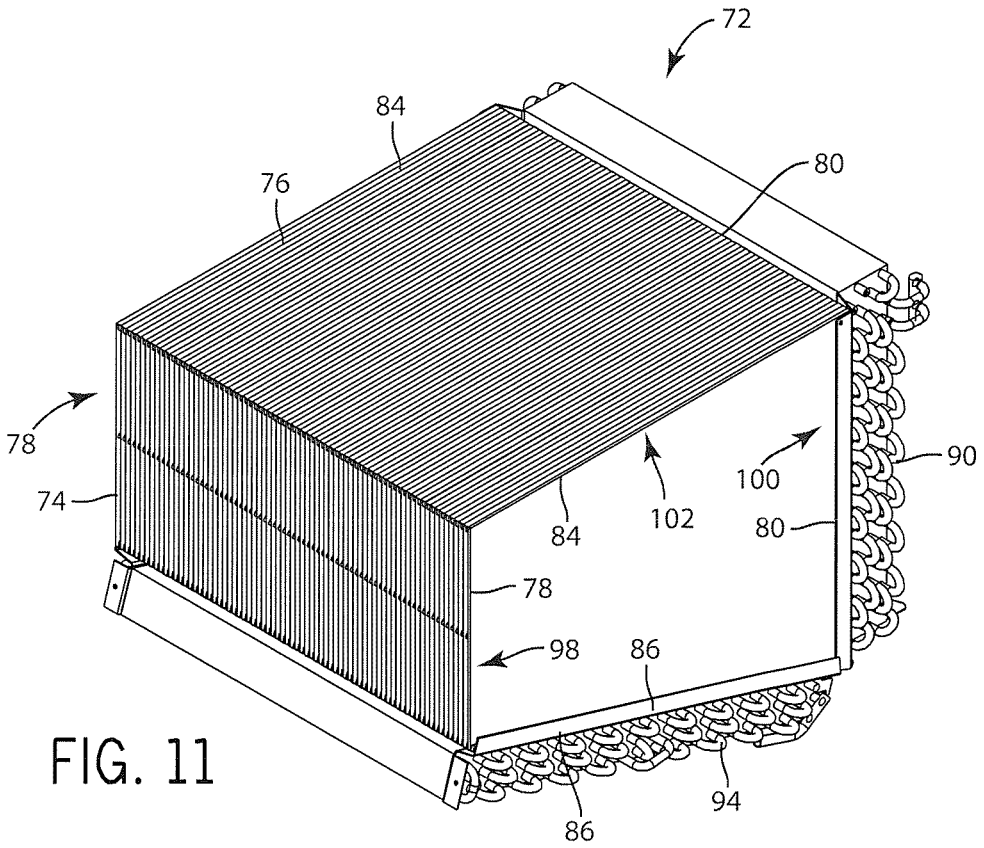
FIG. 11
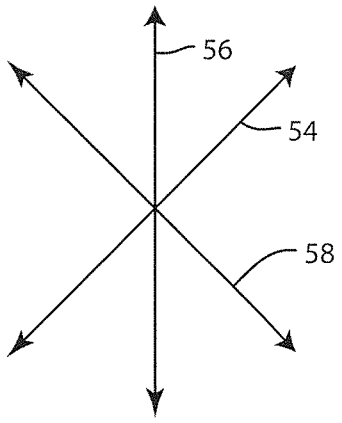

DEHUMIDIFIER

CROSS-REFERENCE TO RELATED APPLICATION

The present application is a continuation of co-pending U.S. patent application Ser. No. 13/298,163, filed Nov. 16, 2011 which is a continuation-in part of U.S. patent application Ser. No. 12/016,858, filed Jan. 18, 2008, which applications are incorporated herein by reference in their entireties.

FIELD

This application relates to improved performance and efficiency in dehumidifiers and cross-flow heat exchangers. Specifically, an improved dehumidifier, cross-flow heat exchanger and method of making a cross-flow heat exchanger are provided.

SUMMARY

In the preferred embodiments, a dehumidifier contains a cross-flow heat exchanger having an axial flow path extending generally horizontally through the heat exchanger from an inlet receiving moist air to an outlet, and a transverse flow path oriented transversely to the axial flow path and extending vertically through the heat exchanger from an inlet to an outlet discharging dry air. The transverse flow path is adjacent to and separate from the axial flow path such that heat is exchanged between media (e.g. air) flowing through the respective paths. The surface area of the inlet of the axial flow path is less than the surface area of the outlet of the axial flow path and, preferably, the surface area of the inlet of the transverse flow path is less than the surface area of the outlet of the transverse flow path. In the most preferred embodiment, the heat exchanger has a generally trapezoidal shape.

According to a preferred method, the heat exchanger is formed by selecting the cross-sectional areas of the inlet and outlet of the axial flow path such that at predefined operating conditions (e.g. temperature and humidity), the pressure drop across each of the axial and transverse flow paths is substantially equal. This empirical process forms an optimally dimensioned heat exchanger that provides improved performance at the predefined operating conditions.

The preferred embodiments provide significant advantages over the art. For example, there is less overall restriction to air flowing through the transverse flow path, which in turn allows for more airflow through the dehumidifier. That is, the area of the heat exchanger adjacent the inlet side of the axial flow path is shorter in the transverse direction, which results in lower restriction on the air passing through the transverse flow path. This also advantageously eliminates unnecessary, inefficient area in prior art heat exchangers, and thus allows for a more compact and space-efficient dehumidifier design. Also, a longer transverse flow path adjacent the outlet of the axial flow path promotes better heat exchange, thus increasing efficiency. In addition, the outlet of the transverse flow path extends at an acute angle from the outlet of the axial flow path, thus further allowing for a more compact dehumidifier and allowing for condensate that accumulates in the axial flow path to drain out of the dehumidifier, thereby further reducing airflow restriction and increasing performance.

BRIEF DESCRIPTION OF THE DRAWINGS

FIG. 7 depicts heat exchange efficiency distribution in the heat exchanger of FIG. 6.

FIG. 8 depicts temperature gradients for the heat exchanger of FIG. 6.

FIG. 9*a* depicts average velocity profiles for the axial flow path of the heat exchanger of FIG. 6.

FIG. 9*b* depicts average velocity profiles for the transverse flow path of the heat exchanger of FIG. 6.

FIG. 11 depicts a perspective view of the heat exchanger of FIG. 6.

DETAILED DESCRIPTION OF THE DRAWINGS

Figure 1:
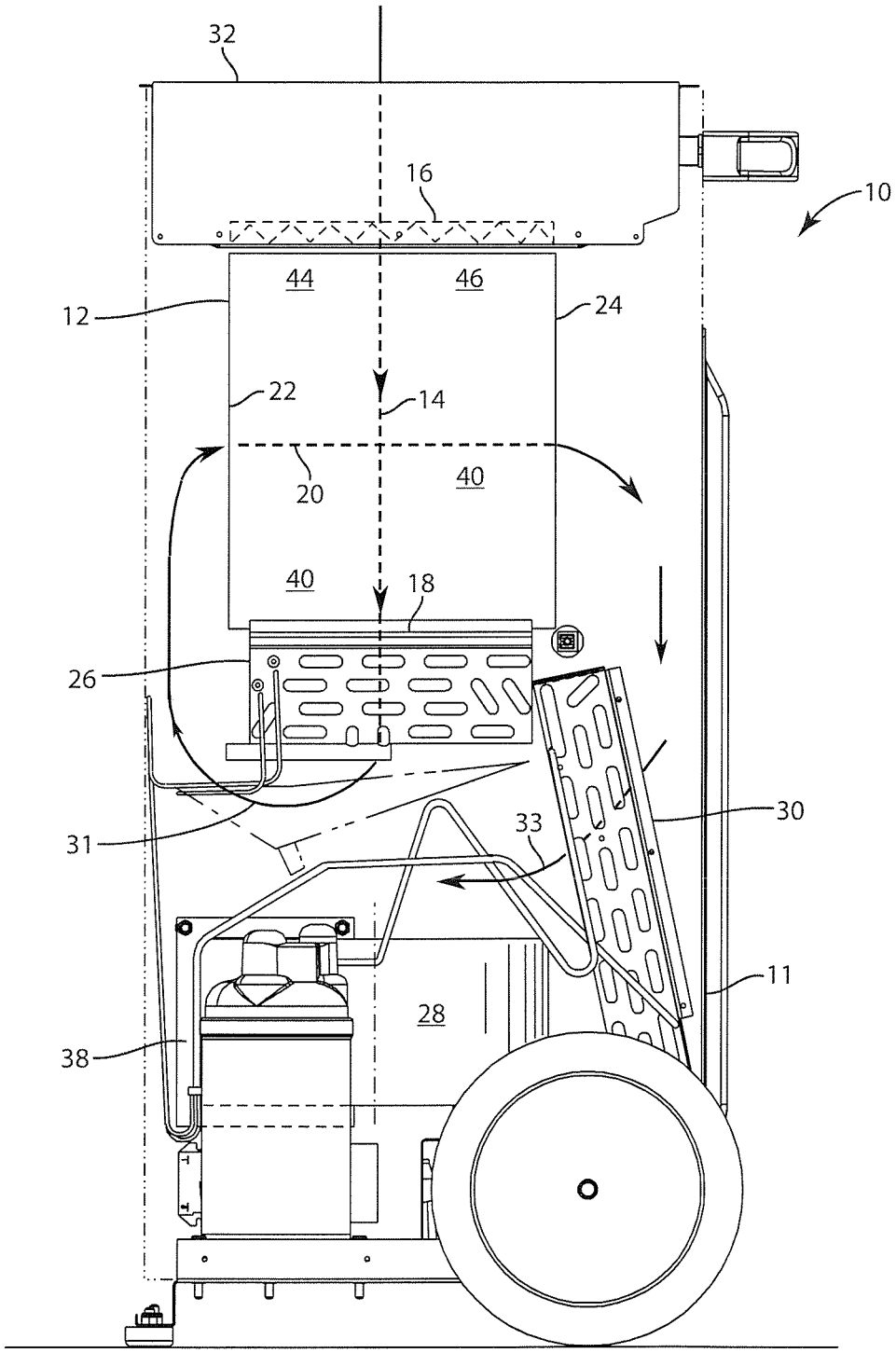
FIG. 1 PRIOR ART
FIG. 1 is a sectional side view of a prior art dehumidifier and heat exchanger arrangement.

FIG. 1 depicts a dehumidifier 10 known in the prior art. Known dehumidifiers 10 include a cabinet 11 containing a square or rectangular heat exchanger 12 for exchanging heat from surrounding air. Heat exchangers 12 typically will have a plurality of corrugated sheets with flutes (not shown) forming open-air pathways through the dehumidifier 10. That is, corrugated sheets (not shown) form a vertical or first axial path 14 extending through the heat exchanger 12 from an inlet 16 to an outlet 18, and corrugated sheets (not shown) form a horizontal or second transverse flow path 20 extending through the heat exchanger 12 from an inlet 22 to an outlet 24. The axial and transverse sheets are adjacent and allow for heat exchange between the media (e.g. air) flowing through the respective flow paths 14, 20. Typically, an evaporator 26 is positioned adjacent the outlet 18 of the axial flow path 14 and a condenser 30 is positioned near the outlet 24 of the transverse flow path 20. A blower 28 is positioned near the condenser 30 and creates a negative pressure for pulling air through the axial flow path 14, and along transverse flow path 20.

During typical operation of the prior art dehumidifier 10, blower 28 draws warm, moist air into the inlet 16 of the axial flow path 14 via an inlet 32 on the dehumidifier cabinet 11. The incoming air enters the axial flow path 14 and is cooled as it passes through the heat exchanger 12, as will be discussed further below. The cool, moist air passes out of outlet 18 of the axial flow path 14 to the evaporator 26, where it is further cooled. The cold, dry air passes out of evaporator 26 and is drawn by blower 28 into inlet 22 of transverse flow path 20. The cold, dry air is moved through the transverse flow path 20 of the heat exchanger 12, where it exchanges heat with and thereby cools incoming warm, moist air flowing along the axial flow path 14, as referenced above. During air flow through the respective axial and transverse flow paths 14, 20, heat is exchanged via the respective corrugated sheets with flutes. The warm, dry air exiting outlet 24 is further heated by condenser 30 and is then returned to the surroundings via outlet 38.

Figure 2:
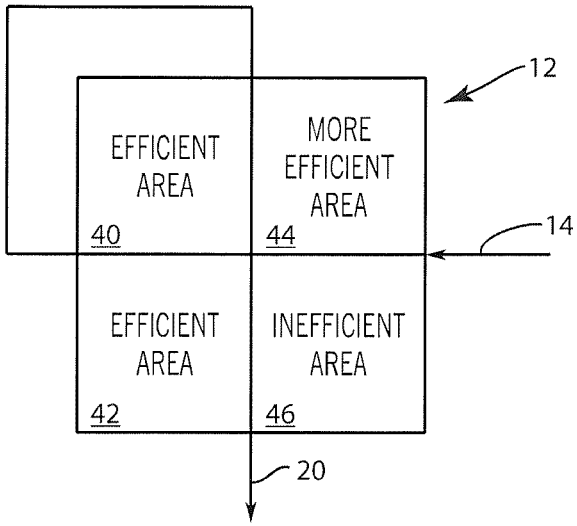
FIG. 2 PRIOR ART
FIG. 2 depicts heat exchange efficiency distribution for the heat exchanger of FIG. 1.
Figure 3:
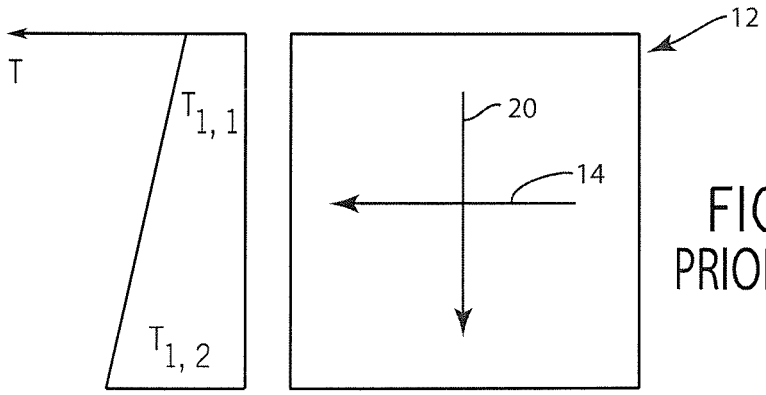
FIG. 3 PRIOR ART
FIG. 3 depicts temperature gradients for the heat exchanger of FIG. 1.

FIG. 2 schematically depicts the efficiency of heat exchange provided by prior art square or rectangular heat exchangers 12. As shown in FIG. 1, certain areas of heat exchanger 12, during operation, provide very little or inefficient amounts of heat exchange. Specifically, there are "efficient areas" 40, 42, a "more efficient area" 44 and an "inefficient area" 46. In general, the inefficient area 46 is in the lower right side of the heat exchanger shown in FIG. 2. The area 46 is inefficient because square or rectangular shaped heat exchanger presents an inefficiently large amount of flow restriction on air flowing along the transverse flow path 20. Also, the temperature differentials between the first and second paths 14, 20 are such that the amount of heat exchanged between the axial and transverse air flows decreases significantly as air travels from inlet 22 to outlet 24 in the transverse direction. FIG. 3 schematically depicts average temperature gradients for the square heat exchanger 12. Here:

$$T_{1,1}<T_{1,2}\text{Let:}\Delta_1=T_{1,2}-T_{1,1}$$

$$T_{2,1}<T_{2,2}\text{Let:}\Delta_2=T_{2,2}-T_{2,1}$$

Figure 4A:
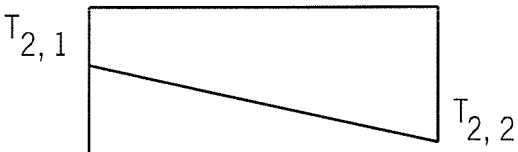
FIG. 4A PRIOR ART
FIG. 4*a* depicts average velocity profiles for the axial flow path of the heat exchanger of FIG. 1.
Figure 4B:
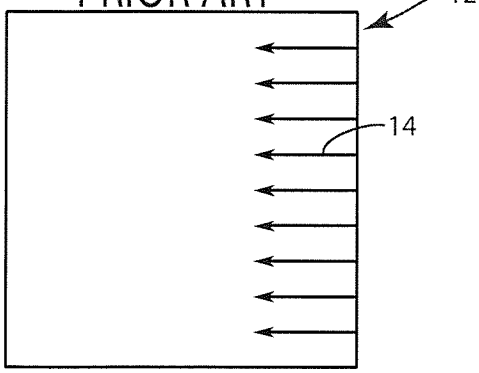
FIG. 4B PRIOR ART
FIG. 4*b* depicts average velocity profiles for the transverse flow path of the heat exchanger of FIG. 1.
Figure 4B:
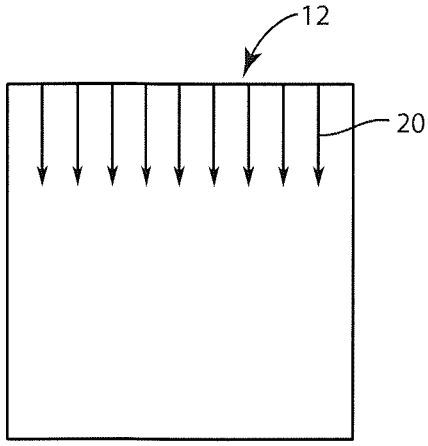
FIG. 4B PRIOR ART

FIGS. 4*a* and 4*b* illustrate the uniform velocity flow profile through the heat exchanger along the axial flow path 14 and the transverse flow path 20. Note that in a uniformly dimensioned heat exchanger 12, the velocity profiles are typically uniform.

The prior art dehumidifier 10 also suffers from other related inefficiencies. For example, the bulky, square-shaped heat exchanger 12 requires the dehumidifier 10 to also have a bulky, space-inefficient shape. Also, several sharp directional changes 31, 33 are required for the air that flows from the axial flow path 14 to the transverse flow path 20, and from the transverse flow path 20 to the outlet 24. These directional changes 31, 33 result in flow friction, which reduces the efficiency and capacity of the dehumidifier 10.

Figure 5:
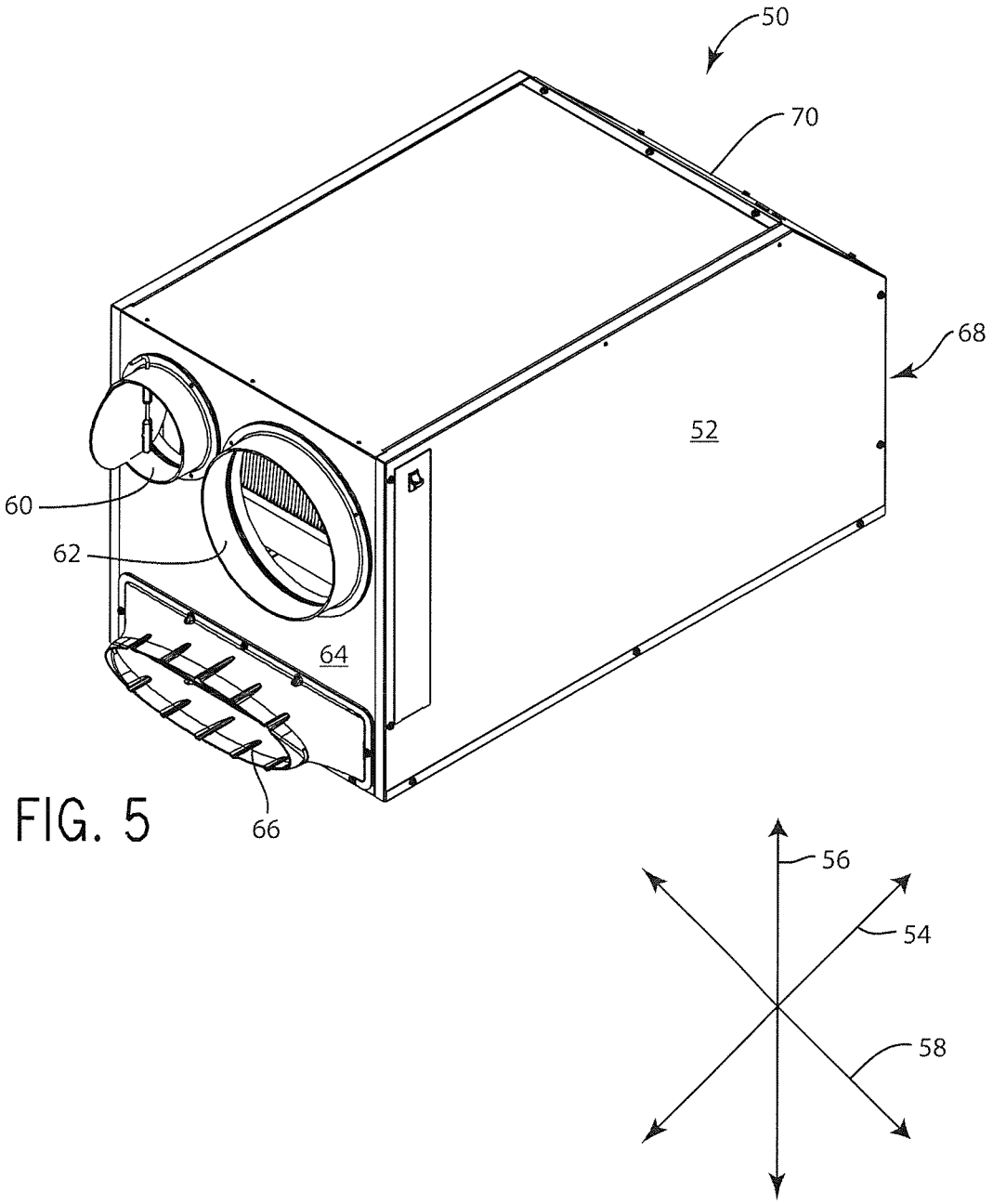
FIG. 5 depicts a dehumidifier according to the present Application.

FIG. 5 is a perspective view of an improved dehumidifier 50 according to the present Application. Three-dimensional housing 52 extends along an axial direction 54, a transverse direction 56 extending perpendicular to the axial direction 54, and a lateral direction 58 extending perpendicular to the axial direction 54 and the transverse direction 56. The housing 52 can be constructed of any material suitable for supporting the various structures that will be described hereinbelow. In the embodiment shown, the housing 52 is made of metal. Inlets 60, 62 are provided at one axial end 64 of the housing 52. Outlet 66 is also provided at the axial end 64. The opposite axial end 68 includes a tapered outer face 70. A generally rectangular housing 52 is depicted, however the housing 52 may have any suitable shape.

Figure 6:
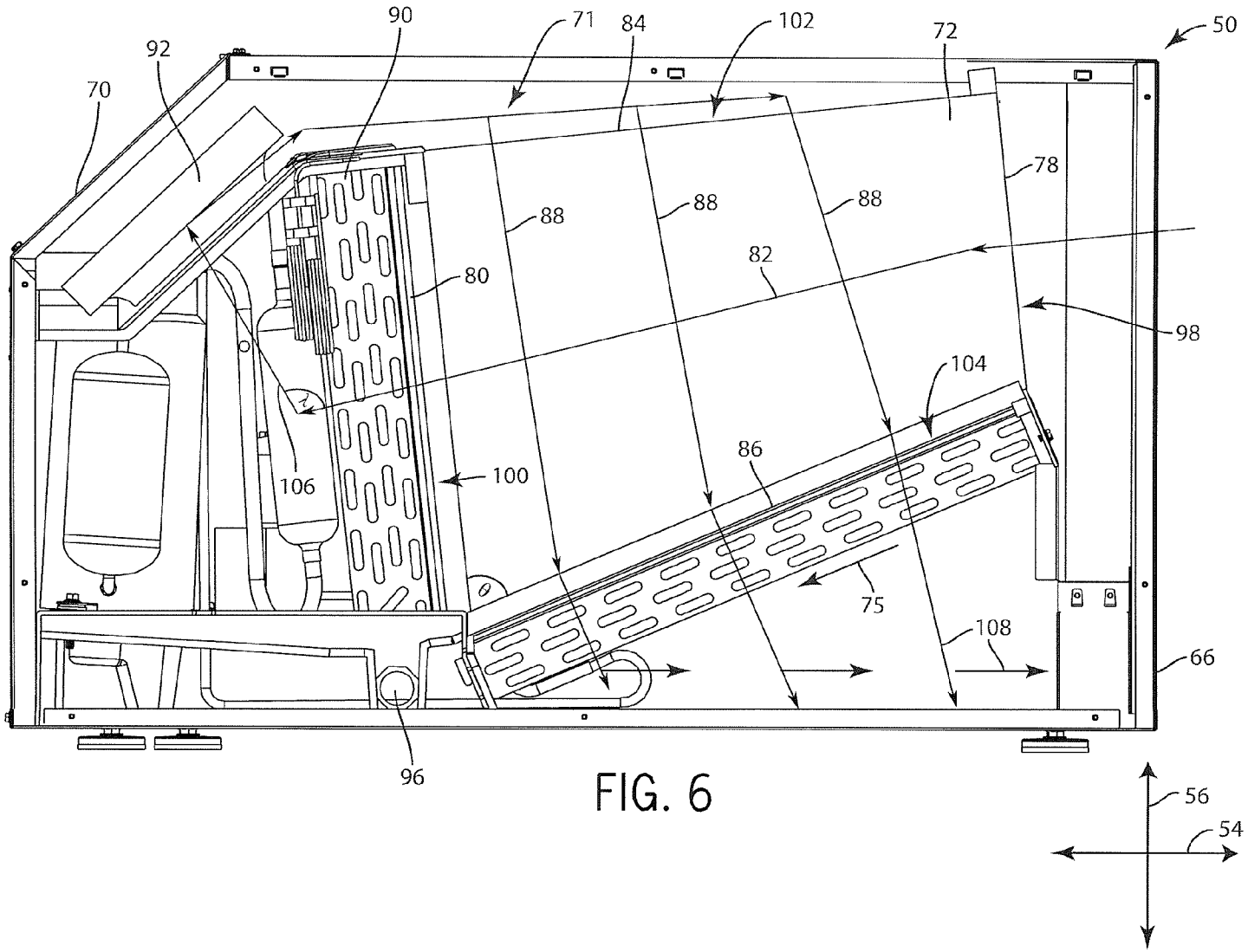
FIG. 6 depicts a sectional side view of the dehumidifier of FIG. 5 and shows a cross-flow heat exchanger according to the present Application.
Figure 10:
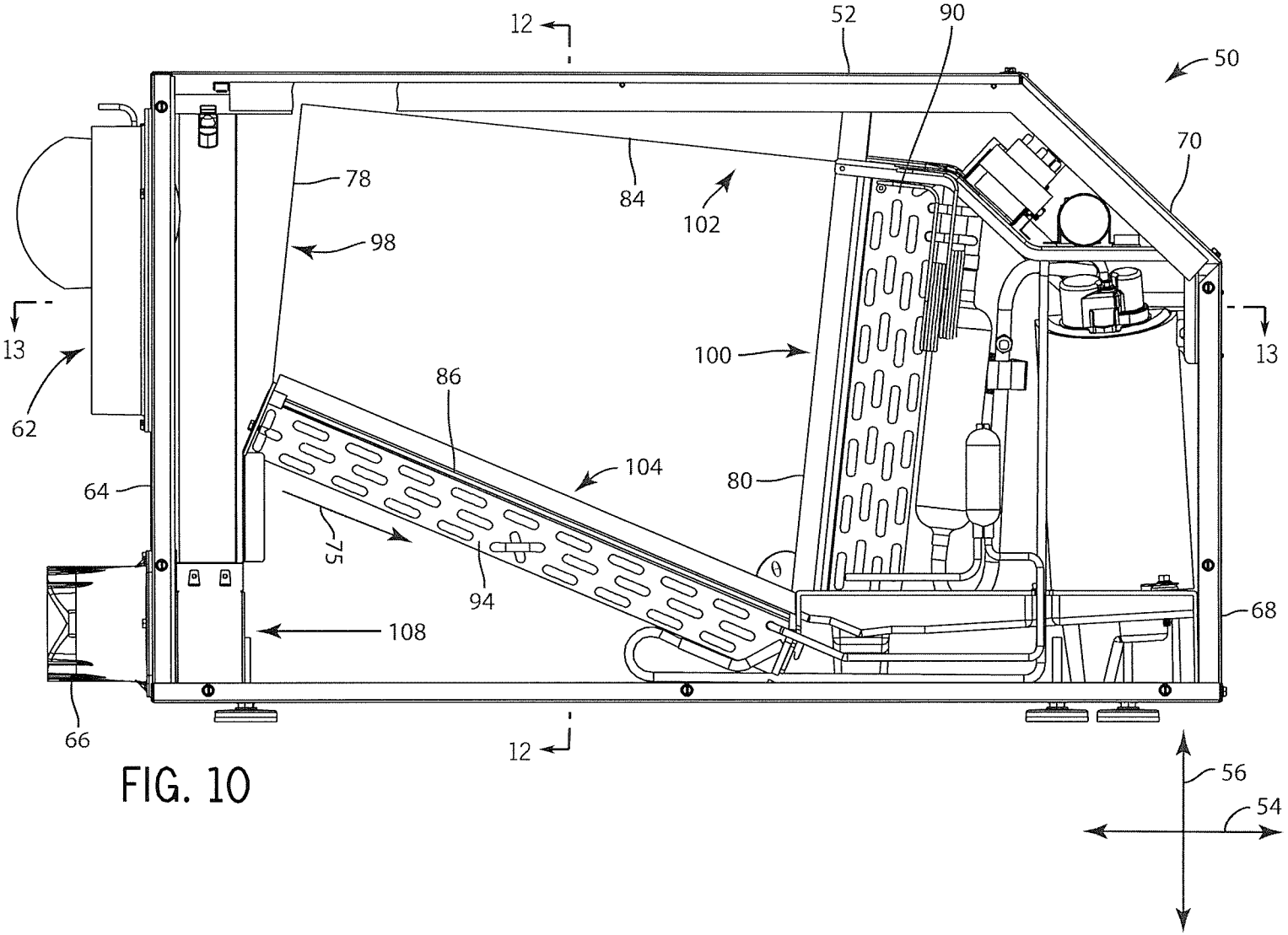
FIG. 10 depicts an opposite sectional side view of the dehumidifier and heat exchanger of FIG. 6.
Figure 12:
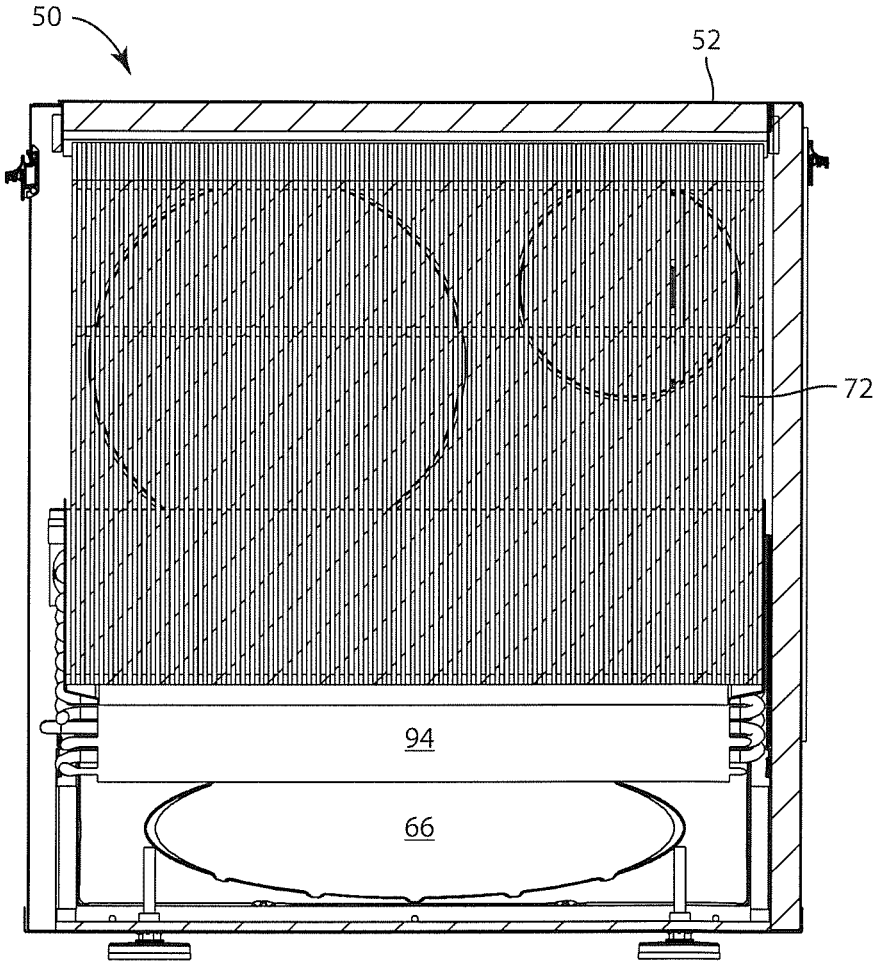
FIG. 12 depicts a cross-sectional view through the dehumidifier and heat exchanger of FIG. 10 along line 12-12.
Figure 13:
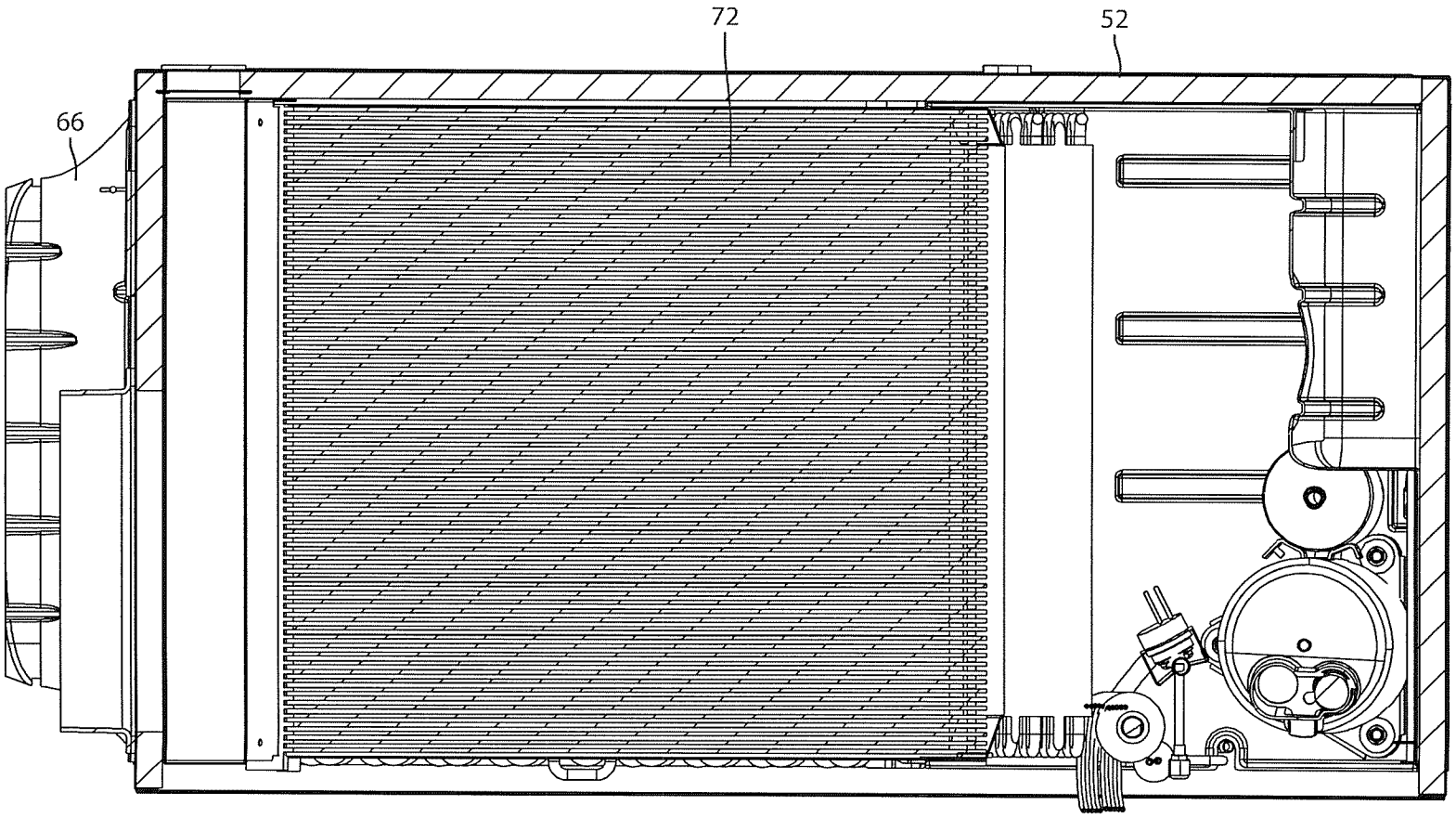
FIG. 13 depicts a cross-sectional view through dehumidifier and heat exchanger of FIG. 10 along line 13-13.

FIG. 6 shows the contents of dehumidifier 50, including trapezoidal-shaped heat exchanger 72, evaporator 90, blower 92 and condenser 94. Trapezoidal-shaped heat exchanger 72 has flutes 74 (see FIG. 11) that extend through the heat exchanger 72 generally in the horizontal or axial direction 54 from an inlet 78 to an outlet 80 and define an axial flow path 82 through the heat exchanger 72, and flutes 76 (see FIG. 11) that extend through the heat exchanger 72 in the vertical or transverse direction 56 from an inlet 84 to an outlet 86 and define a transverse flow path 88 through the heat exchanger 72. Evaporator 90 is positioned adjacent the outlet 80 of the axial flow path 82. Blower 92 is positioned adjacent the inside of tapered outer face 70 and is preferably oriented at an angle λ, which is about 43 degrees to the horizontal axis 54 depicted in FIG. 6. As will be discussed below, the blower 92 is optimally positioned to create a negative pressure on air in the axial flow path 82 and to pressurize the air in area 71 above the inlet 84 and thereby move air from the outlet 80 of the axial flow path 82 to the inlet 84 of the transverse flow path 88 with minimal restriction and directional change. Condenser 94 is positioned adjacent the outlet 86 of the transverse flow path 88 and, as will be discussed further below, is optimally dimensioned and positioned with regards to the outlet 66 to maximize efficiency and minimize air restriction and change of airflow direction.

In its preferred and illustrated form, heat exchanger 72 has a trapezoidal shape, which in the example shown is a right trapezoid in cross-section. Referring to the drawings, heat exchanger 72 has a first axial side 98 (comprising the inlet 78) that has a surface area that is less than the surface area of a second axial side 100 (comprising the outlet 80). The heat exchanger 72 further includes a first transverse side 102 (comprising the inlet 84) that has a cross-sectional area that is less than the cross-sectional area of a second transverse side 104 (comprising the outlet 86). The unique shape of the heat exchanger 72 allows for a condenser 94 that has an increased length when compared to the prior art. This is due to the fact that the second transverse side 104 (i.e. outlet 86) is longer than prior art arrangements. Also, the second transverse side 104 (i.e. outlet 86) is orientated at an acute angle θ (preferably equal to 72°) with respect to the second axial side 100, which advantageously provides for improved drainage of condensate from the heat exchanger 72, as will be discussed below.

During operation, blower 92 creates a negative pressure that draws warm, moist air surrounding the dehumidifier 50 into the inlet 78. More specifically, the air is drawn into the inlet 78 of the heat exchanger 72 and along the axial flow path 82 formed by corrugated sheets 74. As the air travels along the axial flow path 82, it is cooled, as will be explained further below. As the air flowing through the axial flow path 82 is cooled, moisture is removed and drains to drainage outlet 96 in the direction shown by arrow 75. The slope (i.e. acute angle θ) formed between the second axial side 100 and the second transverse side 104 advantageously promotes downward drainage towards the outlet 96 in the direction shown by arrow 75, thus increasing efficiency of the dehumidifier 50. The cool, moist air passes out of outlet 86 of the axial flow path 82 to evaporator 90, where it is further cooled. Cold, dry air passes out of evaporator 90 and is moved by blower 92 towards inlet 84 of transverse flow path 88. Blower 92 is positioned at angle λ such that restriction and directional change in the airflow path 106 from the evaporator 90 to the inlet 84 is minimized. Preferably, blower 92 is arranged at an angle of between 40 and 45 degrees relative to the horizontal axis 54 depicted in FIG. 6. Operation of blower 92 causes increased pressurization of area 71 above the inlet 84 and moves the cold air at saturation into inlet 84 and along the transverse flow path 88, where it exchanges heat with and thereby cools the incoming warm, moist air flowing along the axial flow path 82. Specifically, heat is exchanged between the corrugated sheets 74 of the axial flow path 82 and the corrugated sheets 76 of the transverse flow path 88. Warm air is then heated further by passing through condenser 94 and is returned to the surroundings via outlet 66 in housing 52. The flow of air 108 between the condenser 94 and outlet 66 advantageously has minimal restriction when compared to the prior art. This is due to the unique shape of the heat exchanger 72, and specifically the acute angle θ formed between the second transverse side 104 and second axial side 100.

FIG. 7 schematically depicts the efficiency of heat exchange provided by the uniquely-shaped heat exchanger 72. When compared to the arrangement shown in FIG. 2, the trapezoidal heat exchanger 72 eliminates certain areas in the prior art heat exchangers that, during operation, provide very little heat exchange. Firstly, the increased length of the first transverse side 102 allows for less overall restriction through the heat exchanger 72. This allows for more airflow through the system, thus increasing the efficiency/capacity of the dehumidifier 50. Secondly, the second axial side 100 is more effective because of a longer transverse flow path 88*a* adjacent the second axial side 100. Thirdly, the acute angle θ allows for a more compact design option, thus allowing the overall dehumidifier 50 to be smaller in size. Fourthly, condensate that accumulates in the axial flow path 82 will drain out of the heat exchanger 72 along slope 75, thus reducing the airflow restriction and increasing performance. Also, the area of the heat exchanger 72 adjacent the first axial side 98 is shorter in the transverse direction 56, which provides lower airflow restriction on the air passing through the transverse flow path 88. This also eliminates unnecessary inefficient area of prior art heat exchangers (e.g. 46 in the prior art arrangement of FIG. 2).

FIG. 8 schematically depicts average temperature gradients for the heat exchanger 72. When considering the temperature gradients for heat exchanger 72 in comparison to the gradients for the prior art heat exchanger 46 depicted in FIG. 3:

$$T'_{1,1}>T_{1,1}$$

$$T'_{1,2}<T_{1,2}$$

$$\text{Let:}\Delta'_1=T'_{1,2}-T'_{1,1},\text{then}\Delta'_1<\Delta_1$$

$$T'_{2,1}>T_{2,1}$$

$$T'_{2,2}<T_{2,2}$$

$$\text{Let}\Delta'_2=T_{2,2}-T'_{2,1},\text{then}\Delta'_2<\Delta_2$$

Thus, the heat exchanger 72 reduces the temperature gradient in both the first pass (axial flow path 82) and the second pass (transverse flow path 88) and it is much more efficient that the prior art heat exchanger 12.

FIGS. 9*a* and 9*b* illustrate the velocity profile through the heat exchanger along the axial flow path 82 and the transverse flow path 88.

The cross-flow heat exchanger 72 can be formed in such a way that the optimal dimensions for increased efficiency and capacity are attained. Specifically, when the axial and transverse flow paths 82, 88 are formed through the heat exchanger 50 the inlet 78 of the axial flow path 82 is sized to be smaller than the outlet 80 of the axial flow path 82. The cross-sectional areas of the inlet 78 and outlet 80 of the axial flow path 82 are selected such that at predefined operating conditions, the pressure drop across each of the axial 82 and transverse 88 flow paths is substantially equal. This empirical process produces a heat exchanger having dimensions that are optimal for the particular predefined operating conditions, which typically include a set temperature and humidity. To form the trapezoidal heat exchanger 72 of the preferred embodiment, the height of the axial flow path 82 is formed at its inlet 78 such that it is less than the height of the axial flow path 82 at its outlet 80. The length of the transverse flow path 88 at its inlet 84 is formed such that it is less than the height of the transverse flow path 88 at its outlet 86.

FIGS. 14-22 depict alternate embodiments of the heat exchanger 72, evaporator 90, blower 92 and condenser 94. These elements are positioned relative to each other and for disposition in a dehumidifier, such as for example the dehumidifier 50. The type and arrangement of the dehumidifier can vary. Not depicted in FIGS. 14-22 is the housing 52 shown in the previous embodiments, including inlets 60, 62, and outlets 66. The housing 52 can have any suitable shape for containing the structures shown in FIGS. 14-22. The number and position of the inlets and outlets can vary.

Each of the examples shown in FIGS. 14-22 differs with regard to the relative positioning of the evaporator 90, fan 92 and condenser 94. The examples can also vary with respect to how the arrangement is oriented in the dehumidifier housing and with respect to the noted axial direction 54, transverse direction 56 and lateral direction 58. That is, it is not required that the heat exchanger 72 be oriented in the manner shown in FIGS. 1-13. Any orientation of the heat exchanger is possible with respect to the surrounding components of the dehumidifier.

Figure 14:
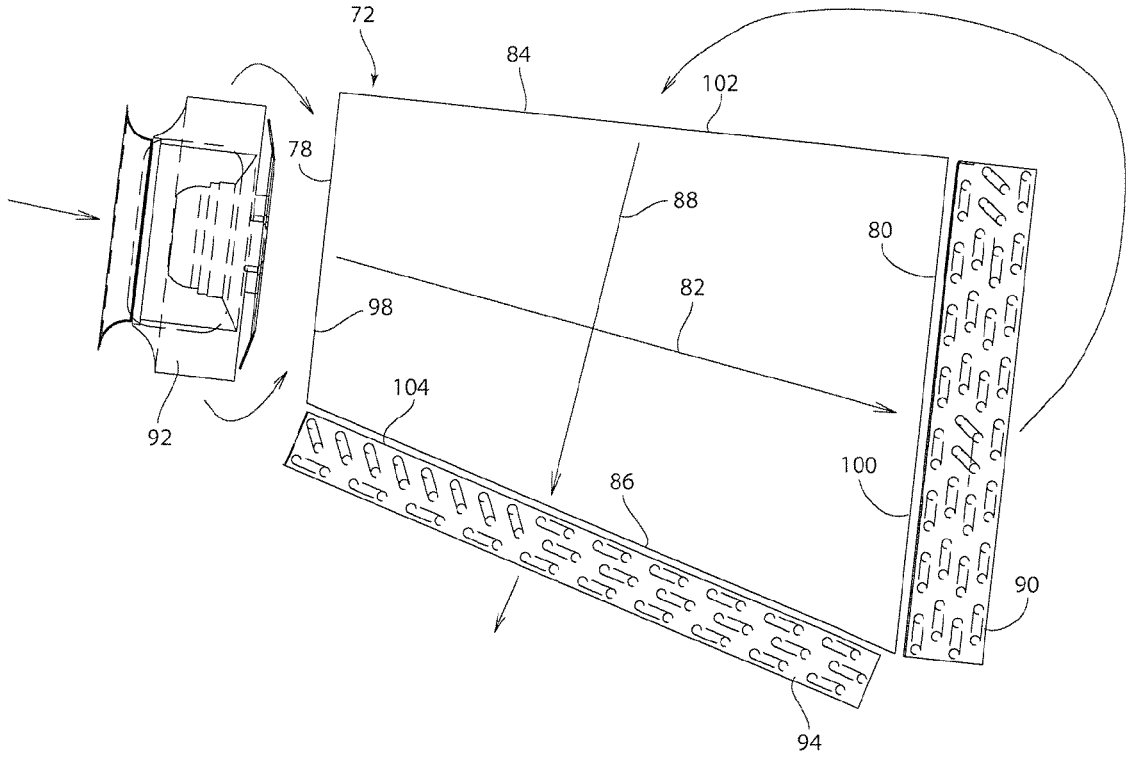
FIG. 14 depicts a sectional side view of the cross-flow heat exchanger, evaporator, condenser, and fan according to another embodiment.

FIG. 14 depicts one example of the dehumidifier wherein the fan 92 is located upstream of the axial flow path 82. In this example, the evaporator 90 is located at the outlet 80 of the axial flow path 82. The condenser 94 is located at the outlet 86 of the transverse flow path 88. The fan 92 moves air through the heat exchanger 72 along the axial flow path 82, through the evaporator 90, along the transverse flow path 88, through the condenser 94, and ultimately for discharge from the dehumidifier.

Figure 15:
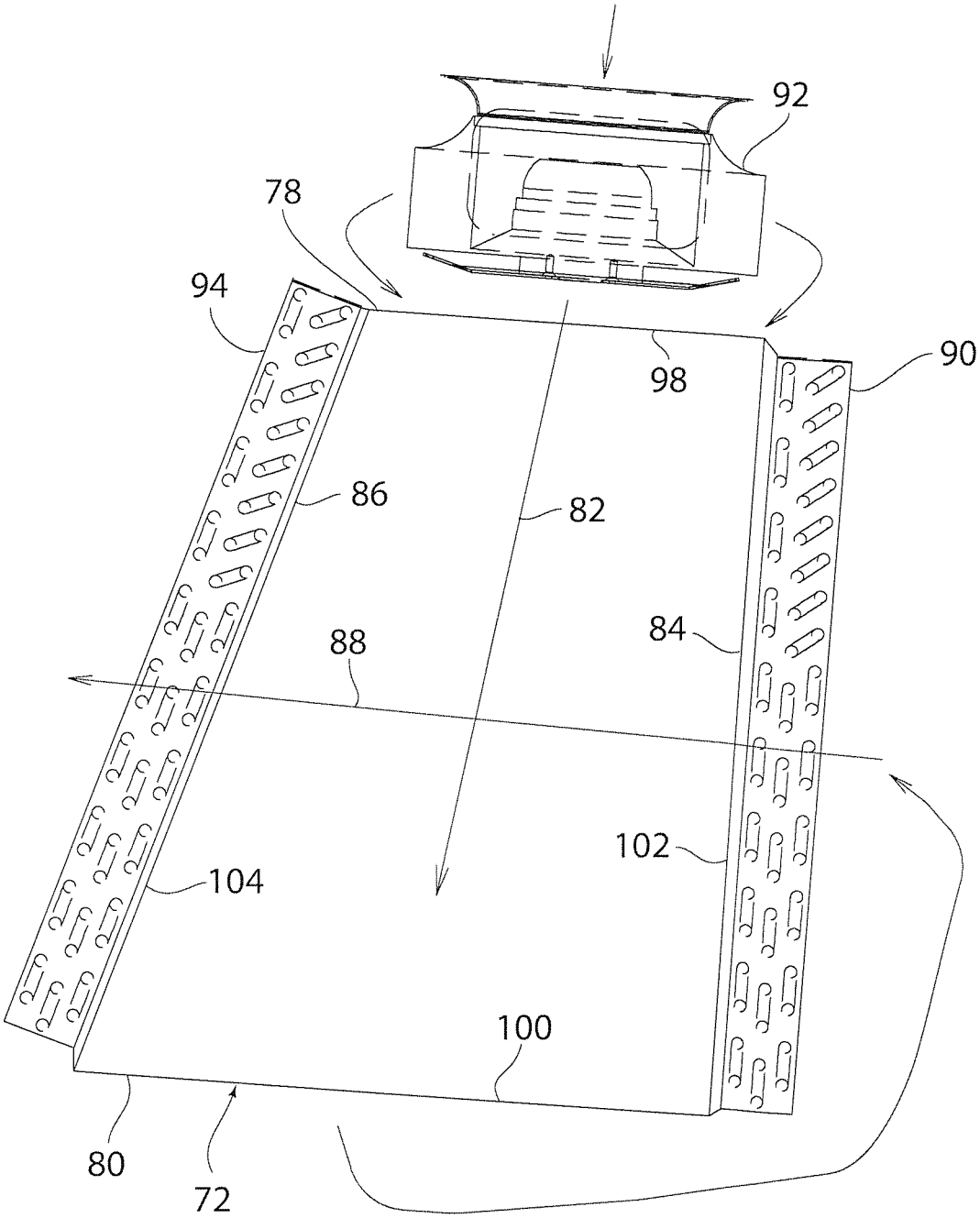
FIG. 15 depicts a sectional side view of the cross-flow heat exchanger, evaporator, condenser, and fan according to another embodiment.

FIG. 15 depicts another example of the dehumidifier wherein the fan 92 is located upstream of the axial flow path 82. In this example, the evaporator 90 is located at the inlet 84 of the transverse flow path 88. The condenser 94 is located at the outlet 86 of the transverse flow path 88. The fan 92 moves air through the heat exchanger 72 along the axial flow path 82, through the evaporator 90, along the transverse flow path 88, through the condenser 94, and ultimately for discharge from the dehumidifier.

Figure 16:
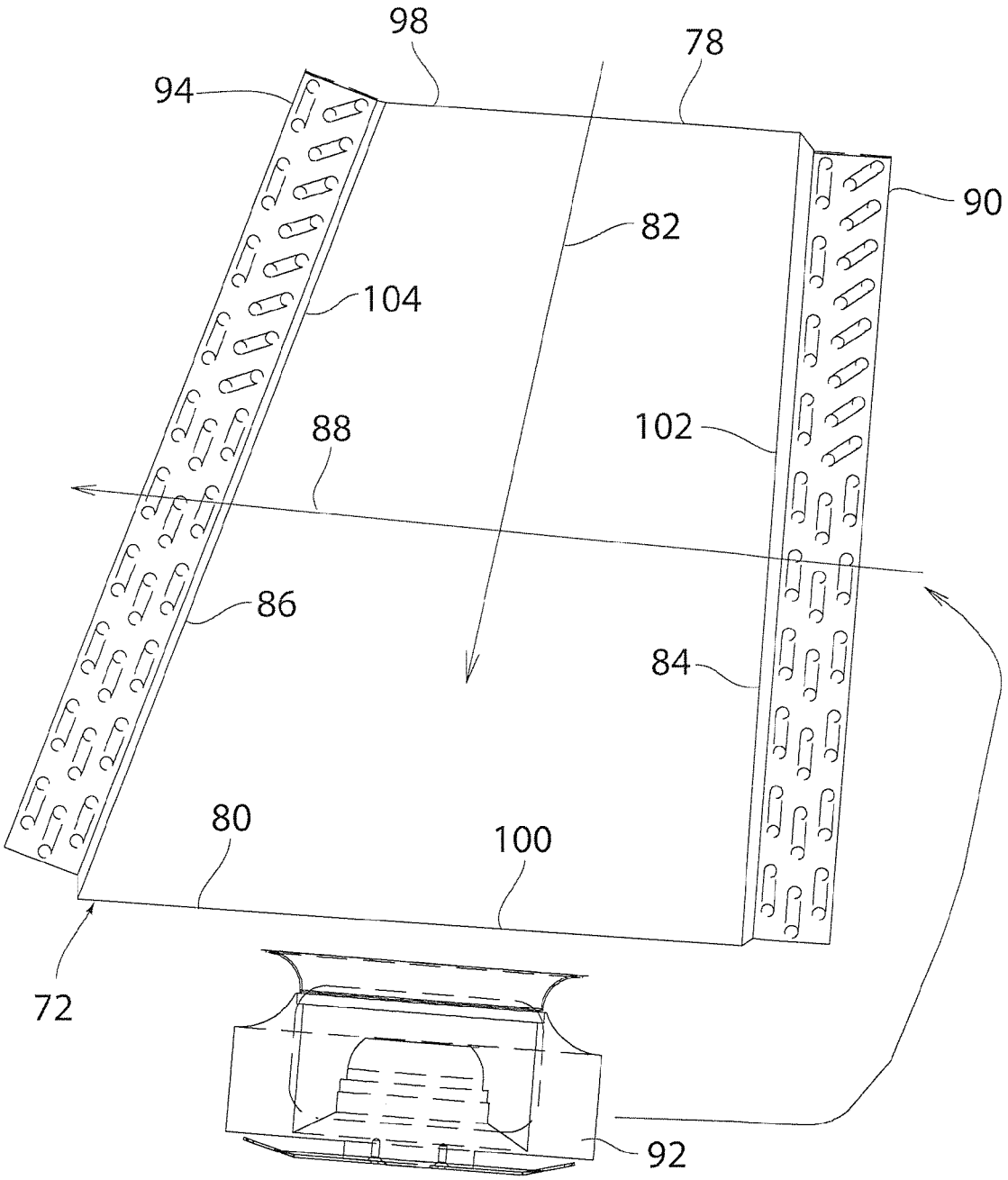
FIG. 16 depicts a sectional side view of the cross-flow heat exchanger, evaporator, condenser, and fan according to another embodiment.

FIG. 16 depicts another example of the dehumidifier, wherein the fan 92 is located downstream of the axial flow path 82 and upstream of the transverse flow path 88. The evaporator 90 is located at the inlet 84 of the transverse flow path 88. The condenser 94 is located at the outlet 86 of the transverse flow path 88. The fan 92 draws air through the axial flow path 82 and then forces air through the evaporator 90, along the transverse flow path 88, through the condenser 94, and ultimately for discharge from the dehumidifier.

Figure 17:
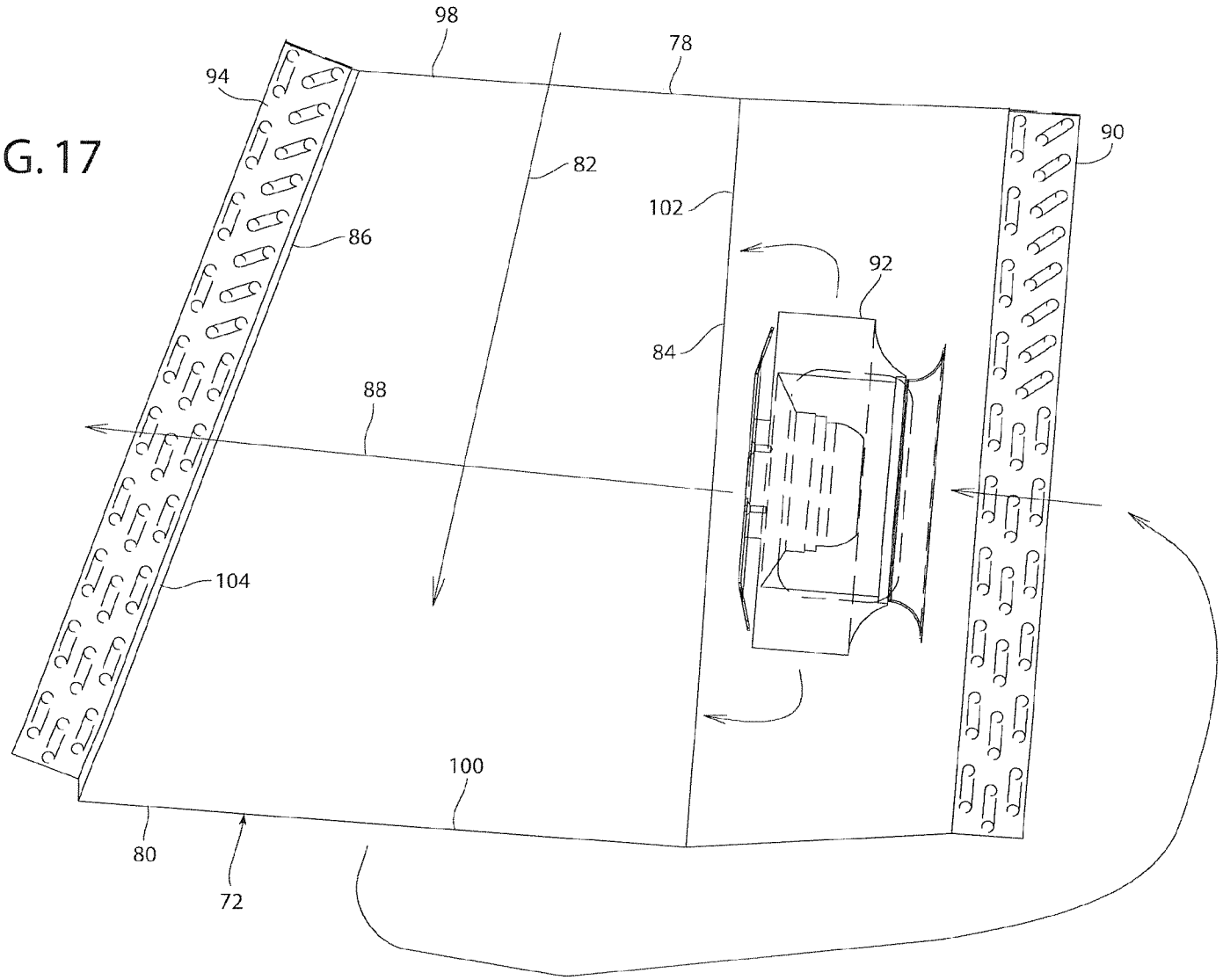
FIG. 17 depicts a sectional side view of the cross-flow heat exchanger, evaporator, condenser, and fan according to another embodiment.

FIG. 17 depicts another example of the dehumidifier, wherein the fan 92 is located downstream of the axial flow path 82 and upstream of the transverse flow path 88. The condenser 94 is located at the outlet 86 of the transverse flow path 88. The fan 92 is located downstream of the evaporator 90. The fan 92 draws air through the axial flow path 82, through the evaporator 90, and blows air along the transverse flow path 88 and through the condenser 94, for discharge from the dehumidifier.

Figure 18:
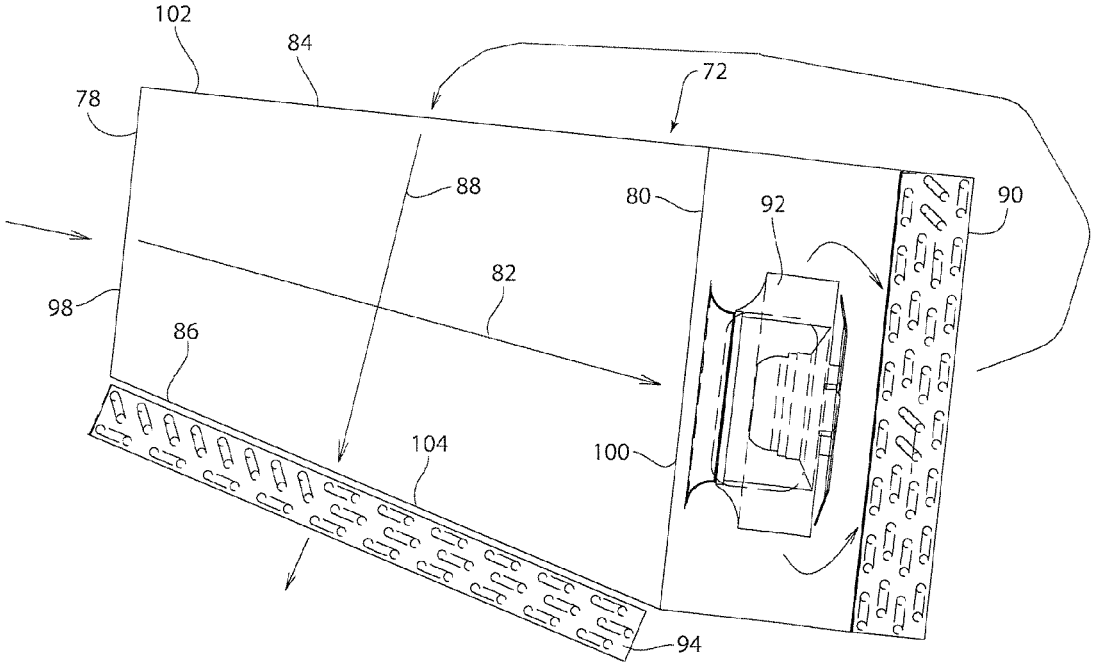
FIG. 18 depicts a sectional side view of the cross-flow heat exchanger, evaporator, condenser, and fan according to another embodiment.

FIG. 18 depicts another example of the heat exchanger, wherein the fan 92 is located downstream of the axial flow path 82 and upstream of the transverse flow path 88. The condenser 94 is located at the outlet 86 of the transverse flow path 88. The fan 92 is located upstream of the evaporator 90. The evaporator 90 is located upstream of the inlet 84 of the transverse flow path 88. The fan 92 draws air through the axial flow path 82 and forces air through the evaporator 90, through the transverse flow path 88, through the condenser 94, for discharge from the dehumidifier.

Figure 19:
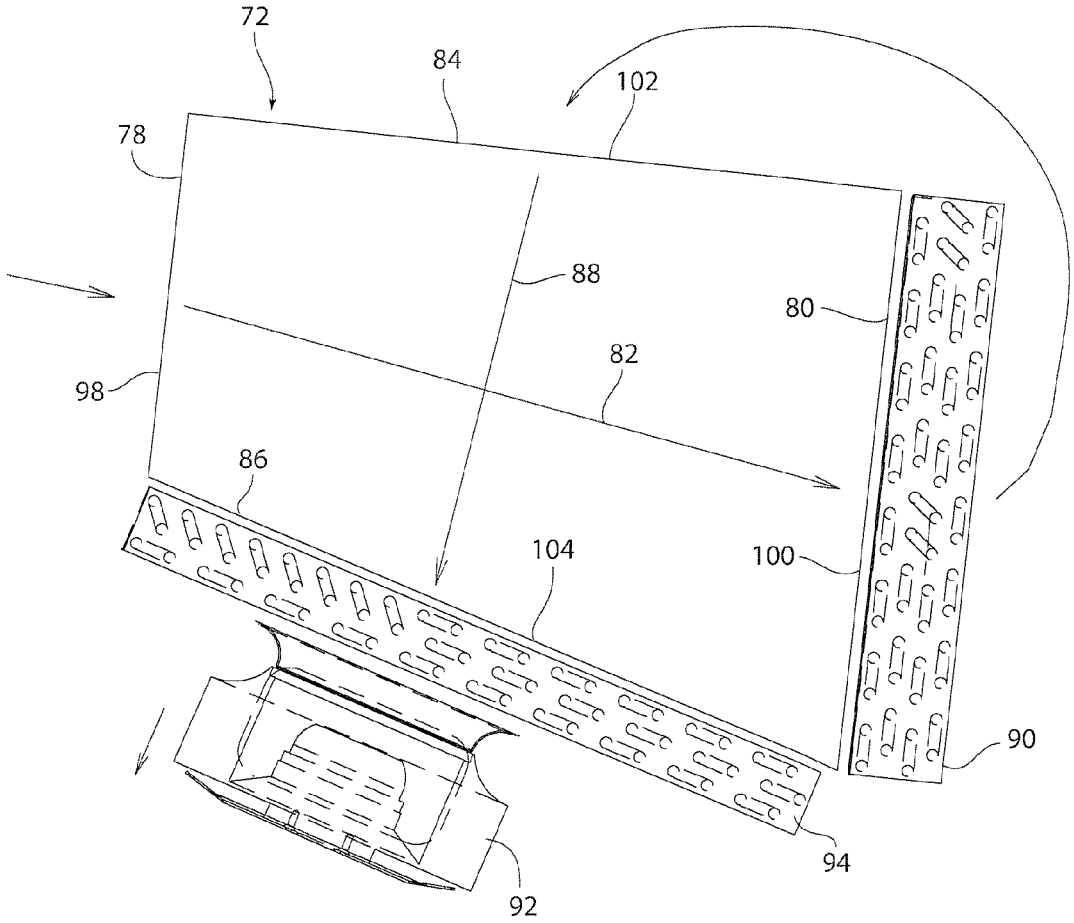
FIG. 19 depicts a sectional side view of the cross-flow heat exchanger, evaporator, condenser, and fan according to another embodiment.

FIG. 19 depicts another example of the dehumidifier wherein the fan 92 is located downstream of the axial flow path 82 and downstream of the transverse flow path 88. The fan 92 draws air through the axial flow path 82, through the evaporator 90, through the transverse flow path 88, and through the condenser 94 and blows air for discharge from the dehumidifier.

Figure 20:
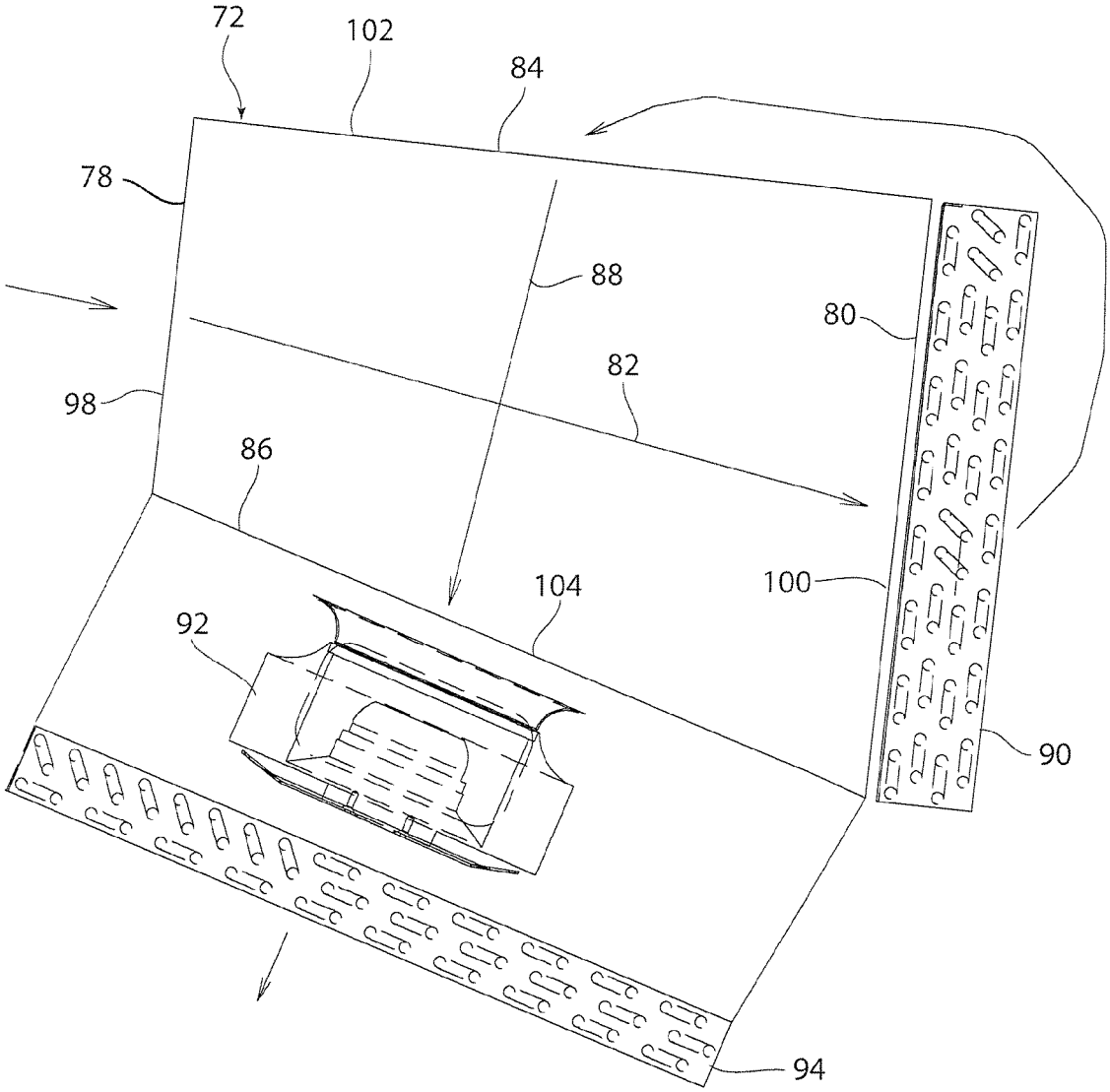
FIG. 20 depicts a sectional side view of the cross-flow heat exchanger, evaporator, condenser, and fan according to another embodiment.

FIG. 20 depicts another example of the dehumidifier wherein the fan 92 is located downstream of the transverse flow path 88 and upstream of the condenser 94. The evaporator 90 is located at the outlet 80 of the axial flow path 82. The fan 92 draws air through the axial flow path 82, through the evaporator 90, and through the transverse flow path 88, and blows air through the condenser 94 for discharge from the dehumidifier.

Figure 21:
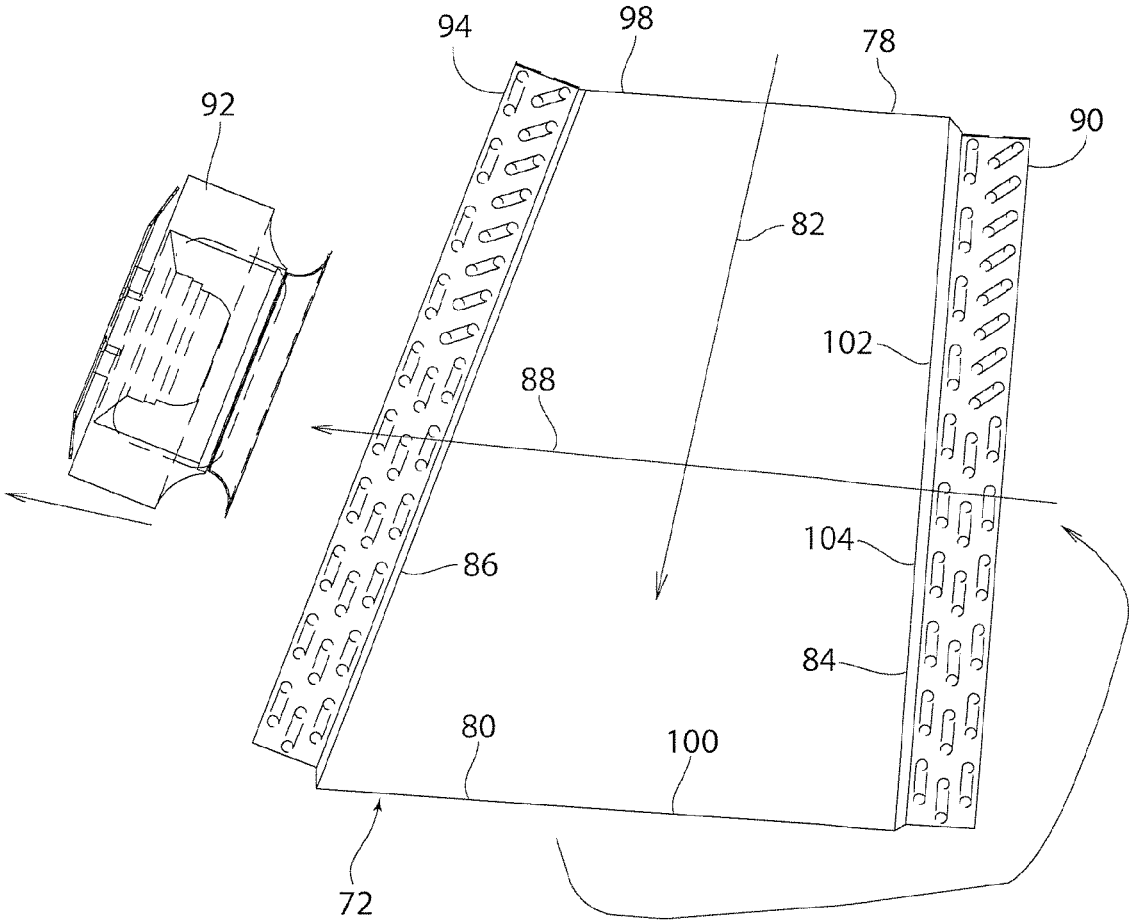
FIG. 21 depicts a sectional side view of the cross-flow heat exchanger, evaporator, condenser, and fan according to another embodiment.

FIG. 21 depicts another example of the dehumidifier wherein the fan 92 is located downstream of the axial flow path 82 and downstream of the transverse flow path 88. The evaporator 90 is located at the inlet 84 of the transverse flow path 88. The fan 92 draws air through the axial flow path 82, through the evaporator 90, through the transverse flow path 88, through the condenser 94, and blows air out of the dehumidifier.

Figure 22:
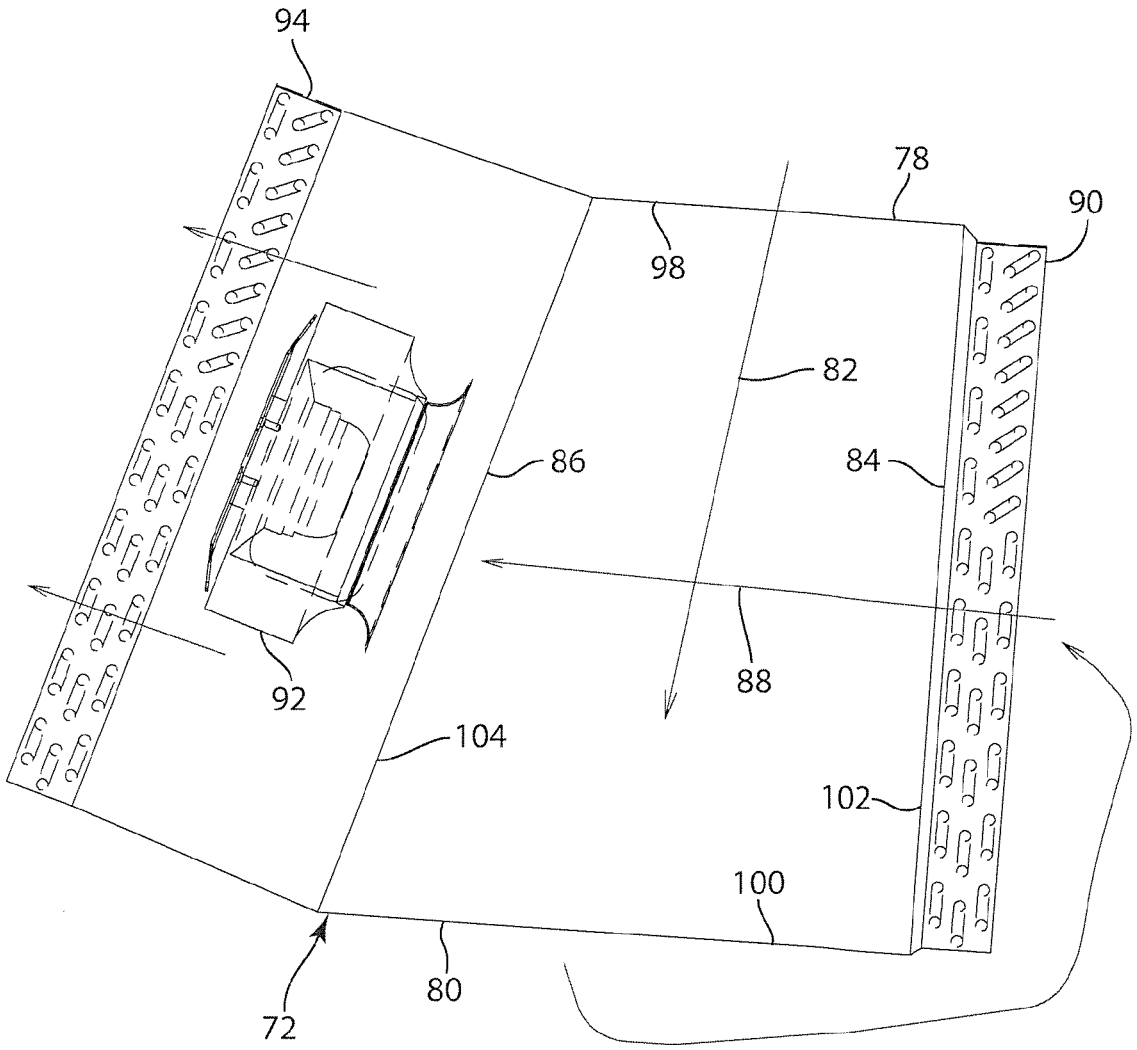
FIG. 22 depicts a sectional side view of the cross-flow heat exchanger, evaporator, condenser, and fan according to another embodiment.

FIG. 22 depicts another example of the dehumidifier, wherein the fan 92 is located downstream of the transverse flow path 88. The evaporator 90 is located at the inlet 84 of the transverse flow path 88. The fan 92 draws air through the axial flow path 82, through the evaporator 90, through the transverse flow path 88, and blows air through the condenser 94 for discharge from the dehumidifier.

It should be understood that the drawings and specification are to be considered an exemplification of the principles of the invention, which is more particularly defined in the appended claims. For example, although the depicted arrangement illustrates a trapezoidal-shaped heat exchanger, the invention is applicable for use with differently-shaped heat exchangers. The concepts of the invention are also applicable for use in a system that operates outside of an environment to be dehumidified, wherein the air streams are ducted to and from the environment.

What is claimed is:

1. A dehumidifier comprising:

a cabinet having an inlet for receiving moist air and an outlet for discharging dry air;

a cross-flow heat exchanger in the cabinet, the cross-flow heat exchanger comprising an axial flow path extending through the heat exchanger from an inlet receiving the moist air to an outlet, the axial flow path including a first axial side and a second axial side, and a transverse how path oriented transversely to the axial flow path and extending through the heat exchanger from an inlet to an outlet discharging the dry air, the transverse flow path including a first transverse side and a second transverse side, the transverse flow path being adjacent to and separate from the axial flow path;

an evaporator positioned adjacent to the outlet of the axial flow path;

a condenser positioned adjacent the outlet of the transverse flow path;

a fan moving air from the evaporator to the inlet of the transverse flow path; and wherein the transverse flow path along the second axial side is longer than the transverse flow path along the first axial side.

2. The dehumidifier according to claim 1, wherein the fan is located upstream of the axial flow path.

3. The dehumidifier according to claim 1, wherein the fan is located downstream of the axial flow path.

4. The dehumidifier according to claim 1, wherein the fan is located downstream of the transverse flow path.

5. The dehumidifier according to claim 1, wherein the fan is located downstream of the axial flow path and upstream of the transverse flow path.

6. The dehumidifier according to claim 1, wherein the evaporator is dimensioned to be larger than the first axial side.

7. The dehumidifier according to claim 1, wherein the first axial side is parallel with the second axial side.

8. The dehumidifier according to claim 1, wherein the axial flow path is elongated in an axial direction and has a width in a lateral direction that is perpendicular to the axial direction and a height in a transverse direction that is perpendicular to the axial direction and the lateral direction;

the transverse flow path is elongated in the transverse direction and has a width in the lateral direction and a height in the axial direction; and the height of the axial flow path at the inlet of the axial flow path is less than the height of the axial flow path at the outlet of the axial flow path and the height of the transverse flow path at the inlet of the transverse flow path is less than the height of the transverse flow path at the outlet of the transverse flow path.

9. The dehumidifier of claim 1, wherein the heat exchanger has a trapezoidal shape in a cross-section taken along the axial and transverse directions.

10. A dehumidifier comprising:

a cabinet having an inlet for receiving moist air and an outlet for discharging dry air;

a cross-flow heat exchanger in the cabinet, the cross-flow heat exchanger comprising an axial flow path extending through the heat exchanger from an inlet receiving the moist air to an outlet, the axial flow path including a first axial side and a second axial side, and a transverse flow path oriented transversely to the axial flow path and extending through the heat exchanger from an inlet to an outlet discharging the dry air, the transverse flow path including a first transverse side and a second transverse side the transverse flow path being adjacent to and separate from the axial flow path;

an evaporator positioned adjacent to the outlet of the axial flow path;

a condenser positioned adjacent the outlet of the transverse flow path; and a fan moving air from the evaporator to the inlet of the transverse flow path;

wherein the axial flow path has a non-uniform velocity flow profile along the first axial side.

11. The dehumidifier according to claim 10, wherein the fan is located upstream of the axial flow path.

12. The dehumidifier according to claim 10, wherein the fan is located downstream of the axial flow path.

13. The dehumidifier according to claim 10, wherein the fan is located downstream of the transverse flow path.

14. The dehumidifier according to claim 10, wherein the fan is located downstream of the axial flow path and upstream of the transverse flow path.

15. The dehumidifier according to claim 10, wherein the transverse flow path along the second axial side is longer than the transverse flow path along the first axial side.

16. The dehumidifier according to claim 10, wherein the velocity flow profile of the axial flow path along the first transverse side is transverse with the velocity flow profile along the second transverse side.

17. The dehumidifier according to claim 10, wherein the axial flow path is elongated in an axial direction and has a width in a lateral direction that is perpendicular to the axial direction and a height in a transverse direction that is perpendicular to the axial direction and the lateral direction;

the transverse flow path is elongated in the transverse direction and has a width in the lateral direction and a height in the axial direction; and the height of the axial flow path at the inlet of the axial flow path is less than the height of the axial flow path at the outlet of the axial flow path and the height of the transverse flow path at the inlet of the transverse flow path is less than the height of the transverse flow path at the outlet of the transverse flow path.

18. The dehumidifier according to claim 10, wherein the heat exchanger has a trapezoidal shape in a cross-section taken along the axial and transverse directions.

19. The dehumidifier according to claim 10, wherein the condenser dimensioned to be larger than the first transverse side.

20. The dehumidifier according to claim 10, wherein the evaporator is located at the outlet of the axial flow path.

21. The dehumidifier according to claim 10, wherein the condenser is located at the outlet of the transverse flow path.

22. The dehumidifier according to claim 10, wherein the condenser as the same dimension as the evaporator.

* * * * *